United States Patent [19]

Inoue

[11] Patent Number: 4,711,709

[45] Date of Patent: Dec. 8, 1987

[54] DIAPHRAGM-ELECTRODE SYSTEM FOR ELECTROCOATING

[76] Inventor: Akito Inoue, 3-7-3, Sunagawa-cho, Tachikawa, Tokyo, Japan

[21] Appl. No.: 784,525

[22] Filed: Oct. 4, 1985

Related U.S. Application Data

[63] Continuation-in-part of Ser. No. 499,818, Jun. 1, 1983.

[30] Foreign Application Priority Data

Jun. 2, 1982 [JP] Japan ..... 57-82002

[51] Int. Cl.[4] ..... C25D 13/00

[52] U.S. Cl. ..... 204/282; 204/299 EC; 204/301

[58] Field of Search ..... 204/299 EC, 300 EC, 204/301, 252, 260, 180.8, 282

[56] References Cited

U.S. PATENT DOCUMENTS 3,620,955 11/1971 Jones ..... 204/299 EC X 3,945,900 3/1976 Klinkowski ..... 204/299 EC X

*Primary Examiner*—T. Tung

*Attorney, Agent, or Firm*—Dressler, Goldsmith, Shore, Sutker & Milnamow

[57] ABSTRACT

A diaphragm-electrode system for electrocoating including an electrode provided as a counterpart electrode corresponding to a substrate that functions as an electrode on one side, and a diaphragm that serves to separate the counterpart electrode from the foregoing substrate acting as the electrode opposing to the former, as well as from the paint components in aqueous solution for electrodeposition. The diaphragm is disposed in a form to encircle the outer surface of a diaphragm backing member. The diaphragm backing member is tubular in form and made of insulating material having a water permeating structure. The counterpart electrode is encased inside of the diaphragm backing member. Between the counterpart electrode and the diaphragm backing member, a water running mechanism is provided in order to forcibly flow water from one side along a direction to the other side. The counterpart electrode placed within the diaphragm backing member is so inserted that it is freely installed or detached by operating from the outside.

2 Claims, 4 Drawing Figures

DIAPHRAGM-ELECTRODE SYSTEM FOR ELECTROCOATING

This is a continuation-in-part of application Ser. No. 499,818, filed June 1, 1983.

BACKGROUND OF THE INVENTION

1. Field of the Invention

The present invention relates to a diaphragm-electrode system for electrocoating, and more particularly to a diaphragm-electrode system for electrocoating that serves as a counterpart electrode in a process for coating by means of electrolytic deposition, wherein a substrate (object to be coated) functions as an electrode provided on one side while the foregoing diaphragm-electrode system functions as the counterpart electrode provided on the other side.

2. Description of the Prior Art

Electrocoating is broadly classified into two catagories: one is a process using anionic paints; and another is a process using cationic paints. Either of those processes gives excellent results in homogeneity as well as in adhesiveness of the films formed over the substrates. Also, the pollution resulting from these processes is low. Therefore, recently, they are finding widespread use, particularly as the most suitable process for undercoating or one-coat finishing, etc. in the field of metal coating. For example, their application is found in automatic film treatment for automobile bodies.

Of the paints used for the electrocoating as mentioned above, as the anionic paints, for example, those which are made to be water soluble by bonding the carboxyl group to a resin of two-thousand in molecular weight are used. As the cationic paints, for example, those which are made to be water soluble by bonding amino groups to resin components of the paints are used. However, even these water soluble paints are very low in degree of ionization after they are dissolved in water. Presently, as a measure to increase the degree of ionization of the paints in water through neutralization, counteragents for neutralization are added to the paints. For example, alkaline neutralizers, such as triethylamine, are mixed in the anionic paints, while acidic neutralizers, such as lactic acid, are mixed in the cationic paints.

As is described above, neutralizers for raising the degree of ionization of the paints are mixed into the respective paints according to the nature of each of the paints. However, on the other hand, an adverse effect is also brought about from the foregoing practice. That is, as the electrodeposition for the substrates goes on and the resin components of the paint in solution gets lowered in amount, the paint must be replenished by feeding it in successively from outside. This causes a continuous acculmulation of amine or lactic acid used as neutralizer in the solution. As the result, problems, such as remelting of the painted surface (film), formation of pinholes, etc., are caused with a serious disturbance in efficiency of the electrolytic deposition as a whole.

To cope with such problems, lately, for example, so called pH control, as proposed in Japanese Patent Application publication for Opposition No. 22231 (1970), is employed for the purpose of preventing the neutralizers from building up in the aqueous solutions. The pH control works as follows. Through the use of an ion exchange membrane, etc., an electrode provided as the counterpart to the substrate that functions as an electrode on the other side is separated from the aforesaid substrate as well as from the aqueous solution. At the same time, the ion exchange membrane, etc. serves to extract amine or lactic acid from the aqueous solution through permeation, thereby preventing the accumulation of the neutralizer in the aqueous solution.

Meanwhile, the aqueous solution surrounding the substrate in a bathing tank for electrodeposition is constantly agitated in order to enhance the efficiency of electrodeposition. In addition, the water for draining out the neutralizer on the side of the counterpart electrode that is separated by means of the flat sheet form the ion exchange membrane is supplied continuously from the outside although in a very small amount. Consequently, the flat plate form ion exchange membrane mentioned above constantly receives irregular, high and low alternate pressures from both sides. The alternate pressures are applied repeatedly with an impulsive manner or with slow and gentle manner. Practically, the alternating pressure is created not only by the agitation of the aqueous solution for electrodeposition, but also by the operation of moving the substrate into or out of the bathing tank and the process of in-tank carriage of the substrate that is hung on the product line.

As to the variation in water pressure in this case, for the ordinarily used ion exchange membrane ( about 1 m in height, about 50 cm in width), if the variation in water pressure created is 0.5 kg/cm$^2$, the variation in water pressure affecting the membrane as a whole becomes 2500 kg. This means that a tension of about 8.5 kg/cm$^2$ is applied repeatedly to the installing portion of the membrane. Under such a situation, the ion exchange membrane (diaphragm) is continually subjected to bending action imposed to a part of it or to the whole of it. Due to the repeated impression of bedning stress and tensile force, it is impossible to use thin membranes. Even thick membranes are frequently broken within a short period of time (actually, within 2–3 days). The result is the necessity of replacing the ion exchange membrane at regular, short intervals. This in turn requires the preparation of a crane, etc. for carrying out the exchange work. In addition, the electrocoating process line itself has to be stopped.

Moreover, the following problem has also be unsolved. That is, around the counter-electrode described above, impurities which have passed through the ion exchange membrane as well as impurities in the water get attracted and polarized. Besides, due to the electrolysis of the water, bubbles are created around the counterpart electrode. These polarized particles and bubbles are impossible to be removed by the use of the conventional method of continuously trickle feeding water. Accordingly, the efficiency in electrodeposition gets lower with the passage of time. Thus, these persistent drawbacks, that is the extremely poor efficiency and accompanying high cost, have troubled the electrocoating by the use of diaphragm-electrode process based on the conventional art.

In addition to the above-mentioned various problems, there has been another problem left unsolved in electrocoating. The problem pertains to the wear of electrode rod (melting of the electrode due to electrophoresis). The work for exchanging or refilling the electrode rod requires a lot of labor.

SUMMARY OF THE INVENTION

The present invention is intended to obviate the aforesaid disadvantages of the prior art, and the general object of the present invention is to provide a diaphragm-electrode system for electrocoating that is capable of effecting a significant improvement in the overall efficiency of the electrocoating operation.

Another object of the present invention is to provide a diaphragm-electrode system for electrocoating wherewith the efficiency in electrodeposition is upgraded.

A further object of the present invention is to provide a diaphragm-electrode system for electrocoating with markedly improved durability.

A still further object of the present invention is to provide a diaphragm-electrode system for electrocoating wherein the work load for exchanging the component members is reduced a great deal.

The present invention achieves the aforesaid objects in a manner that is the diaphragm-electrode system for electrocoating, the electrode is encased in a diaphragm. This diaphragm-electrode system for electrocoating includes an electrode provided as the counterpart of the substrate for coating that functions as another electrode opposing to the counterpart electrode described above, and a diaphragm that serves to separate the counterpart electrode from the substrate as well as from the paint components in the aqeuous solution for electrodeposition.

Practically, the diaphragm in the diaphragm-electrode system for electrocoating of the present invention is provided in a form of being wound around the outer surface of a tubular form member serving to support the diaphragm which is made of an insulating material having the characteristic that the liquid can permeate. The counterpart electrode described above is actually disposed inside of the diaphragm backing member. Between this counterpart electrode and the diaphragm backing member, a water running mechanism to forcibly flow water from one side towards the other side is provided. The counterpart electrode encased within the diaphragm backing member is so disposed that it can be freely detached to or inserted from outside.

BRIEF DESCRIPTION OF THE DRAWINGS

The above-mentioned features and objects of the present invention will become more apparent by reference to the following description taken in conjunction with the accompanying drawings, wherein like references numerals denote like elements, and in which.

DETAILED DESCRIPTION OF THE INVENTION

Detailed description will hereunder be given of an embodiment of the present invention with reference to the drawings.

Figure 1:
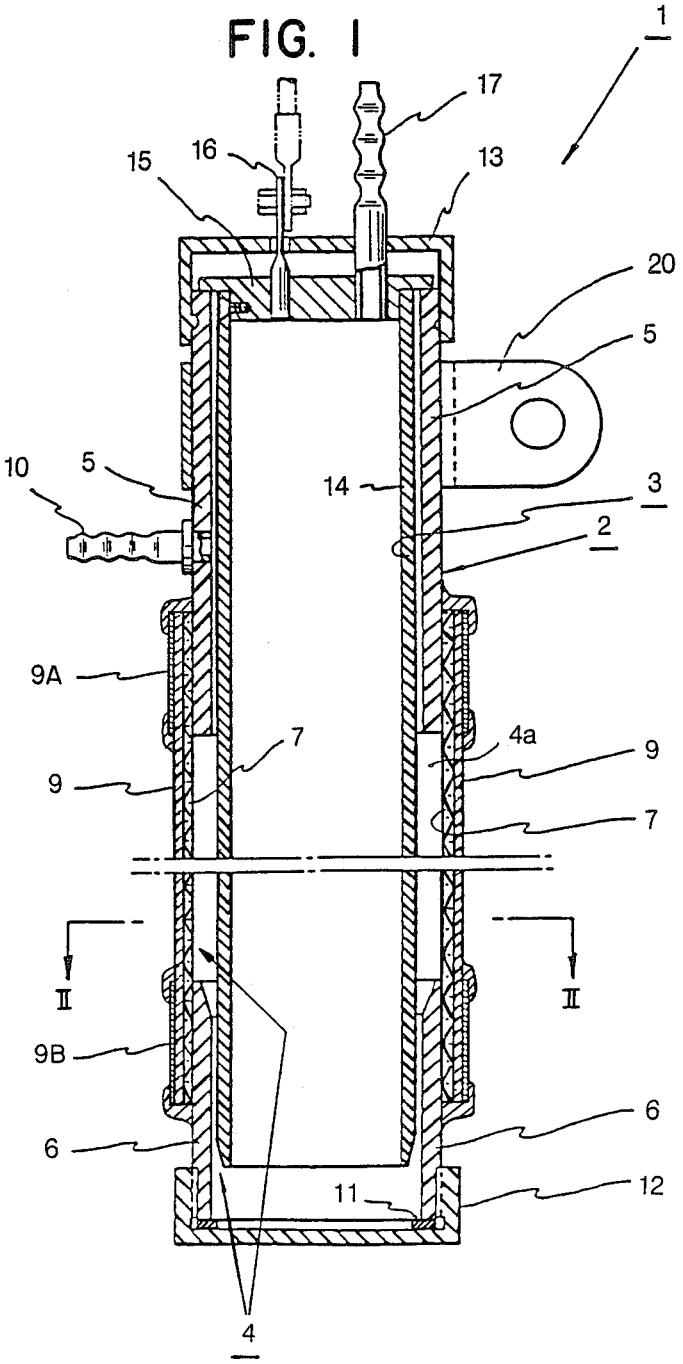
FIG. 1 is a vertical section showing an embodiment of the present invention.
Figure 2:
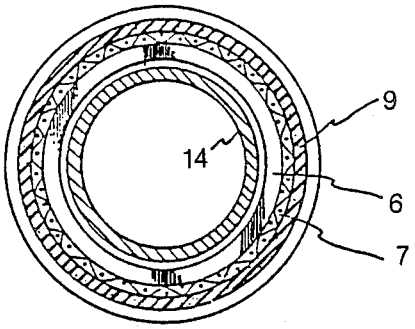
FIG. 2 is a sectional view taken along the line II—II in FIG. 1.
Figure 3:
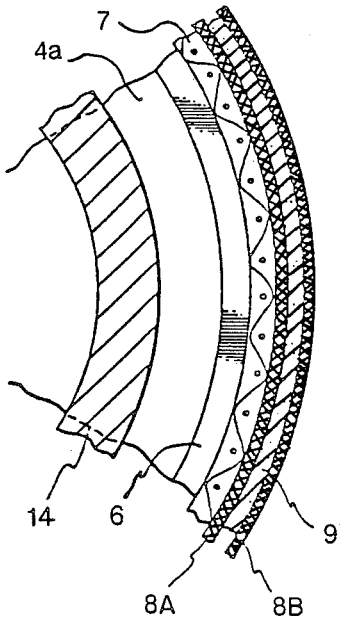
FIG. 3 is an enlarged diagram showing a part of FIG. 2.

In FIG. 1 through FIG. 3, 1 indicates the diaphragm-electrode system disposed in an aqeuous solution for electrodeposition and functions as a counterpart electrode corresponding to an electrode (substrate or object to be coated) on one side that is not shown in the drawings. The diaphragm-electrode system 1 includes a body assembly 2, an electrode assembly 3, and a water running mechanism 4 that is provided between the body and electrode assemblies 2 and 3.

The body assembly 2 includes first and second insulating tubes 5 and 6, a diaphragm backing member 7, a piece of cloth 8A, a diaphragm 9, and a cover cloth 8B. The first and the second insulating tubes 5 and 6 are disposed on a coaxial circle line with a preset distance provided between them. The diaphragm backing member 7 is relatively hard and serves to connect the respective insulating tubes 5 and 6. The diaphragm 9 is disposed in a form to encircle the outer circumference of the diaphragm backing member 7 with the cloth 8A (see FIG. 3), etc. inserted in between to form an intermediate layer. The external cover cloth 8B covers the outer surface of the diaphragm 9 by forming an encircling layer.

The cloths 8A and 8B used are made of chemical fibers, etc., and are water permeable as well as of sufficient durability against tensile force. The diaphragm backing member 7 is formed of a nonconductive reticular material or water permeable porous material, and it is disposed in a manner to connect the first and second insulating tubes 5 and 6 at their outside diameter sides. The upper and lower ends of the diaphragm 9 wound around the diaphragm backing member 7 shown in FIG. 1 are pressed and reinforced by means of fixing bands 9A and 9B at their outer circumferences. Furthermore, the upper and lower ends of the diaphragm 9 are fixed to the respective insulating tubes 5 and 6 by molding and at the same time sealed against water using a synthetic resin. With the foregoing structure provided, the diaphragm 9 is able to be completely separate from the electrode assembly 3 encased inside of the diaphragm 9 and can be readily detached or inserted into aqueous solution for electrodeposition. Also, the first insulating tube 5 is provided with a drainage 10. On the other hand, at the bottom of the second insulating tube 6 shown in FIG. 1, a waterproof cap 12 with a rubber packing 11 provided therein is fitted. Also, onto the top of the first insulating tube 5, a positioning cap 13 serving to keep the electrode assembly 3 at approximately center position in the body assembly 2 is mounted in a manner to be freely detached or fitted.

The diaphragm 9 is made of an ion exchange membrane that is selectively permeable to ions drawn to the electrode assembly 3. In addition to the foregoing ion exchange membrane, a neutral membrane. that does not have the selectivity but allows small molecules to pass through it easily while checking the passage of relatively large molecules through it may also be used for forming the diaphragm 9. Because such ion exchange membrane or neutral membrane is installed as the diaphragm 9 in a form which is wound around the diaphragm backing member 7, the mechanical strength of the diaphragm 9 is reinforced substantially.

As to the electrode assembly 3, it is composed of a hollow tubular electrode 14, a metal lid 15, a connecting terminal for a power source 16, and a water feeder (inlet) 17. The tubular electrode is made of stainless steel shaped into a tubular form. The metal lid 15 is fitted to the upper end of the tubular electrode 14 as shown in FIG. 1, and serves to hold the electrode to keep it from sinking vertically by engaging with electrode 14. The connecting terminal for the power source 16 and the water feeder 17 are provided in the lid 15.

Of the component members of the electrode assembly 3 described above, the tubular electrode 14 is formed such that its outside diameter is smaller than the inside diameters of the first and second insulating tubes 5 and 6 of the body assembly 2. This arrangement makes it possible not only for the tubular electrode 14 to be inserted into or detached from the body assembly 2 easily, but also allows the water running mechanism to be formed in part between the body assembly 2 and the tubular electrode 14. Furthermore, the metal lid 15 is provided such that its outer rim edge sticks out over the tubular electrode 14 Therefore, the tubular electrode 14 can be anchored to the first insulating tube 5 as shown in FIG. 1. As the result, the electrode assembly 3 can be smoothly inserted into the body assembly 2 and also can be readily detached and taken out of the body assembly 2 when necessary.

Figure 4:
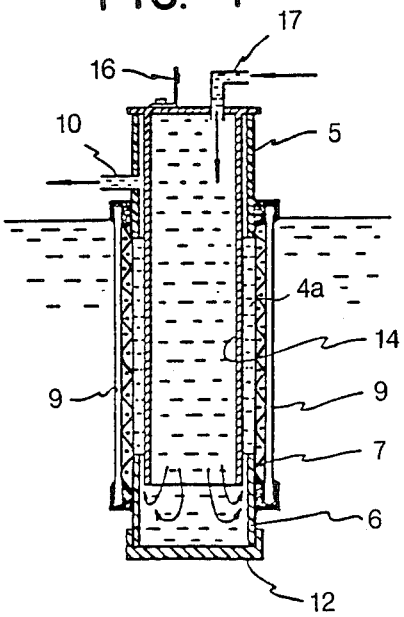
FIG. 4 is a diagram showing the aspect of water flow along inside of the system.

The water running mechanism 4 is provided for the purpose of purging lactic acid, etc. which are built up between the diaphragm 9 and the tubular electrode 14 to outside. Practically speaking, the water running mechanism 4 is formed by the electrode assembly 3 and the body assembly 2. In other words, it works as described below. That is, as indicated by the arrows in FIG. 4, the water fed from the water feeder 17 of the electrode assembly 3 goes down along the space inside of the tubular electrode 14. Then, the water flows from the lower portion of the tubular electrode 14 toward the outer circumferential side of the tubular electrode 14 and into a narrow gap channel 4*a* between the tubular electrode 14 and the diaphragm backing member 7. While going up along the outer circumferential surface of the tubular electrode 14 in the narrow gap channel 4*a*, the wat creates a turbulent flow under positive pressure, and finally is forcibly purged together with impurities to the outside by way of the drainage 10. In a preferred construction the narrow gap channel 4*a* should be about 25 mm.

To a part of the first insulating tube 5 of the body assembly 2, a fitting metal 20 for installing the system from the bathing tank for electrocoation is provided in the form of being wound around it. The cloths 8A and 8B layered respectively in round form onto the both surfaces of the diaphragm 9 are not necessarily limited to being fabric material; but the other materials may be used instead, provided that they are of sufficient strength and water permeability. Also, when the joints are sealed tightly against the water, the diaphragm 9 may be coiled in spiral form, or may be formed into ring slices and fitted in position.

Next, the overall behavior of this embodiment will be explained with regard to the process wherein cationic paint is used.

First, in the aqueous solution of cationic paint prepared by neutralizing with lactic acid, the substrate (not shown in the drawings) and the diaphragm-electrode system 1 are placed. Then, a d.c. voltage is impressed by using the substrate as negative electrode while using the tubular electrode 14 of the diaphragm-electrode system 1 as positive electrode. Immediately, the electrocoating is started. During this operation, in the aqueous solution, the resin components of the paint and the colloidal molecules of the pigment which are loaded with positive charge move toward the substrate as the negative electrode; then, after they get discharged by adhering to the surface of the substrate, the solid matter of the paint cohere and form the paint film. Meanwhile, with consumption of the resin components in the aqueous solution, lactic acid loaded with negative charge gets accumulated in the abovementioned aqueous solution. However, this lactic acid begins to move toward the tubular electrode 14 of the diaphragm-electrode system 1, upon initiation of the process of the electrocoating.

In light of the use of cationic paint for the aqueous solution for electrodeposition by dissolving it, an anionic membrane or a neutral membrane is used as the diaphragm 9 since such anionic membrane or neutral membrane allows the easy passage of the lactic acid molecules loaded with negative charge. As a result, the lactic acid molecules which are drawn to the tubular electrode 14 of positive potential pass through the diaphragm 9 with no difficulty. After reaching the tubular electrode 14 formed around the said tubular electrode 14, the lactic acid molecules get discharged. In this case, since the diaphragm 9 is an ion exchange membrane, it is relatively impermeable to the neutralizer after discharge. Consequently, between the tubular electrode 14 and the diaphragm 9, lactic acid is accumulated. On the other hand, as was described previously, pure water is run forcibly between the tubular electrode 14 and the diaphragm 9, thereby effecting a continuous movement of the accumulated lactic acid to outside to be drained together with the pure water.

Improvements shown by this embodiment are as described below. As has been mentioned above, in this embodiment, the electrode provided as the counter part of the substrate functioning as the other electrode is designed to be of a tubular form, and around this tubular electrode 14, the diaphragm 9 made of ion exchange membrane, etc. is provided in the form of encircling layers with the diaphragm backing member 7 made of an insulating material inserted in between. Because of such a structure, the embodiment can withstand the variation in external pressures described above. Therefore, even with the use of a diaphragm made of the same material of the prior art, this embodiment can be used continuously for a long period of time. In addition, since it is designed to forcibly run the water in an upward direction from below toward the space along the diaphragm backing member 7, the polarized particles and bubbles stagnating around the tubular electrode 14 can be forcibly eliminated. Thus, in this regard, the efficiency in electrocoating can be improved substantially. Furthermore, the neutralizers, such as lactic acid, extracted by way of the diaphragm 9 can be completely purged to outside. In this respect too, a marked improvement is achieved by this embodiment compared with the diaphragm-electrode system based on the conventional technique wherein the neutalizers, such as lactic acid, accumulated around the electrode are merely diluted with water. Accordingly, a notable upgrading in neutralizer extracting efficiency at the diaphragm 9 is implemented. In addition, as the tubular electrode 14 can be readily deteached and taken out of the body assembly maintenance becomes very easy with an accompanying advantage of total elimination of the necessity of providing accessory equipment, such as a crane. Moreover, since this embodiment includes water permeable cloths 8A and 8B covering and lining the diaphragm 9 in the form of layers encircling the outer and inner circumferential surfaces of the diaphragm 9, respectively, even if the tensile strength of the diaphragm 9 is extremely low, the diaphragm with this laminated structure is able to be sufficiently resistive to the variations in internal pressure.

Because of the improvements achieved as described above, when a plural number of diaphragm-electrode systems having the foregoing structure are used by disposing them in the aqueous solution for electrodeposition, the drawbacks accompanying the diaphragm process based on the prior art are completely obviated. For example, as to the durability of the diaphragm itself, because it is reinforced by the diaphragm backing member 7, it can hold itself sufficiently against external pressure. Also, against the internal pressure, for example, when four of the diaphragms 9 with the structure laminated encircling layers and with an internal diameter of 5 cm are used, while the surface area of the total membranes is increased to be larger than that of the diaphragm by the prior art, the effect of the tubular form structure works. As the result, with a 0.5 $kg/cm^2$ variation in internal pressure in each of the respective diaphragm-electrode systems 1, the tension applied to each of the diaphragms 9 along its circumference is only about 1.25 $kg/cm^2$ Consequently, when a diaphragm with 2 $kg/cm^2$ in enduring strength against tension is used, while in the prior art the variation in tension at the installing portion of the diaphragm becomes about 8.5 $kg/cm^2$ and the diaphragm is immediately broken from its installing portion, the diaphragm of this embodiment is able to sufficiently withstand the tensile variation even if the cloths 8A and 8B are not provided around the diaphragm due to the structural effect of being formed into tubal shape.

In this embodiment, the counterpart electrode mentioned above is provided by using a tubular electrode 14. However, in the present invention, the foregoing counterpart electrode is not necessarily limited to be tubular in form, but it may take the other forms, such as columnar form, slendar plate form, so long as the water running mechanism is provided.

As should be apparent from what has been delineated so are, the problems suffered by the prior art as described above can be solved by the present invention, with improvements achieved as recapitulated below. That is, the durability of the diaphragm is enhanced remarkably, and it is designed for a diaphragm-electrode system for electrocoating to forcibly flow the water around the counterpart electrode by feeding the water from outside and running it along a direction from one side toward the other side. As a result, the bubbles and the molecules of polarized impurities which are adhered to the counterpart electrode can be removed forcibly, thus leading to improved efficiency in electrocoating. Furthermore, the overall size of the diaphragm-electrode system for electrocoating is made smaller. Also, the counterpart electrode disposed inside of the diaphragm backing member is encased in a manner to be easily handled from the outside to insert or detach it freely. This makes it feasible to exchange the electrode alone separately from the diaphragm. Therefore, the diaphragm installed originally can be used continuously for a long period of time; and in the meantime, only the counterpart electrode encased in it can be exchanged quite easily These improvements in turn contribute to the unprecedentedly upgraded efficiency in overall process of the electrocoating.

I claim:

1. A diaphragm-electrode system for electrocoating paint onto a substrate and for removing neutralizers comprising an electrode provided as a counterpart electrode corresponding to said substrate functioning as an electrode, and a diaphragm serving to separate the counterpart electrode from said substrate electrode as well as from paint components in an aqueous solution for electrodeposition characterized in that:

said diaphragm is wound around an outer surface of a tubular form diaphragm backing member made of an insulating material provided with a liquid permeable structure;

said counterpart electrode is hollow and in encased within said diaphragm backing member so as to define a narrow gap channel of less than 25 millimeters between said counterpart electrode and said diaphragm backing member;

a water running mechanism to forcibly flow water through said narrow gap channel wherein water is introduced under a positive pressure through an inlet at one end of said hollow counterpart electrode, flows inside of said hollow electrode to the other end of said electrode, flows into the said narrow gap channel and flows through said channel creating a turbulent flow to said one end at which point the water flows out of the diaphragm-electrode system through an outlet, said inlet and outlet for the water being provided on the same side of the diaphragm-electrode system and said counterpart electrode disposed in said diaphragm backing member is installed in a manner to be easily inserted or deteched;

whereby paint neutralizers are removed from the aqueous solution and a diaphragm-electrode system for electrocoating paint onto a substrate in which the diaphragm and counterpart can be easily replaced is provided.

2. A diaphragm-electrode system according to claim 1, wherein said diaphrgm is an anion exchange membrane.

* * * * *